US006595494B1

(12) United States Patent
Roodenburg et al.

(10) Patent No.: US 6,595,494 B1
(45) Date of Patent: Jul. 22, 2003

(54) HOISTING DEVICE, WITH COMPENSATOR BUILT INTO HOISTING CABLE SYSTEM

(75) Inventors: Joop Roodenburg, Delft (NL); Adriaan Jan Rodenburg, Rotterdam (NL)

(73) Assignee: Huisman Special Lifting Equipment B.V., Schiedam (NL)

( * ) Notice: Subject to any disclaimer, the term of this patent is extended or adjusted under 35 U.S.C. 154(b) by 0 days.

(21) Appl. No.: 09/807,078

(22) PCT Filed: Apr. 27, 2000

(86) PCT No.: PCT/NL00/00276

§ 371 (c)(1),
(2), (4) Date: Jul. 2, 2001

(87) PCT Pub. No.: WO01/18350

PCT Pub. Date: Mar. 15, 2001

(30) Foreign Application Priority Data

Oct. 19, 1999 (NL) ..... PCT/NL99/00649

(51) Int. Cl.[7] ..... B63B 23/02
(52) U.S. Cl. ..... 254/277; 254/285; 254/900
(58) Field of Search ..... 254/900, 277, 254/377, 290–291, 285, 387

(56) References Cited

U.S. PATENT DOCUMENTS 3,658,298 A * 4/1972 Moore et al. ..... 254/286
3,714,995 A * 2/1973 Hanes et al. ..... 175/27
3,791,628 A * 2/1974 Burns et al. ..... 254/277
3,804,183 A * 4/1974 Duncan et al. ..... 173/4
3,917,230 A * 11/1975 Barron ..... 175/27
4,423,994 A * 1/1984 Schefers et al. ..... 166/178
4,620,692 A * 11/1986 Foreman et al. ..... 254/277
4,688,764 A * 8/1987 Nayler et al. ..... 254/277
4,867,418 A * 9/1989 Daniels ..... 254/277
5,894,895 A * 4/1999 Welsh ..... 175/40

FOREIGN PATENT DOCUMENTS

GB 2171974 A * 9/1986 ..... B66C/13/04

* cited by examiner

*Primary Examiner*—Kathy Matecki
*Assistant Examiner*—Sang Kim
(74) *Attorney, Agent, or Firm*—Buskop Law Group; Wendy Buskop

(57) ABSTRACT

The invention is a hoisting device for a vessel with a mast in the form of a tube or sleeve with fixed cable blocks on the top side, a trolley with moveable pulleys, a feature on the bottom side for gripping a load, a hoisting system with at least a hoisting cable and a winch, wherein the hoisting cable is guided over the cable blocks and pulleys of both the mast and the trolley in order to move the trolley relative to the mast with the aid of the hoisting system, and a compensator located in the mast in the form of a pneumatic or hydraulic cylinder for damping movements of the vessel as a result of heave and beating of the waves characterized in that the hoisting cable is guided over cable pulleys that are connected to the ends of the compensator.

13 Claims, 17 Drawing Sheets

3
7
17
10
12
51
52

HOISTING DEVICE, WITH COMPENSATOR BUILT INTO HOISTING CABLE SYSTEM

FIELD OF THE INVENTION

The present invention relates to a hoisting device, provided with a mast, on the top side provided with cable blocks; a trolley, which is movably fixed on the mast, on the top side is provided with cable blocks; and on the bottom side is provided with means for gripping a load; hoisting means, at least equipped with a hoisting cable and a winch, said hoisting cable being guided over the cable blocks of both the mast and the trolley, and it being possible to move the trolley relative the mast with the aid of the hoisting means; and a compensator, in the form of a pneumatic or hydraulic cylinder, for damping movements of the vessel as a result of heave and beating of the waves.

BACKGROUND OF THE INVENTION

Various hoisting devices are known from the prior art. These hoisting devices are used in the offshore industry as drilling masts on, for example, drilling vessels. When, in use, a drill string is attached to the bottom side of a trolley, also known as a traveling block, the compensator has to compensate for the movements of the vessel relative to the seabed. The drill string itself will rest at least partially in the earth's surface during the drilling and will make a minimal movement relative to the earth's surface. The vessel, on the other hand, does move under the influence of the waves and the flow of the water.

According to the prior art, the compensator is generally placed between two blocks or trolleys, both of which can move relative to the mast. In this case the top trolley will be provided with cable pulleys, which can be moved relative to the mast with the aid of a hoisting cable. The bottom trolley will be attached to the top trolley by means of the compensator. When in this construction forces are exerted by the drill string upon the bottom trolley, these forces will be transmitted only partially to the top trolley.

The compensator generally used operates hydro-pneumatically. The hydro-pneumatic compensator will therefore be connected to a compressed air device by means of hoses, pipes and the like. A relatively large stroke volume is necessary for good functioning of such a compensator. Since both blocks or trolleys move relative to the mast, the compensator will also be able to move relative to the mast, which is a disadvantage. The connections of the compressed air device to the compensator must in fact also be able to move relative to the mast. This requires the use of, for example, flexible hoses and pipes, and all that makes the connection relatively complex, and therefore expensive.

SUMMARY OF THE INVENTION

It is a first object of the present invention to provide for a hoisting device according to the type mentioned in the preamble, in which the connections of a compressed air device to the compensator can be fitted at a stationary point.

That object is achieved in the present invention by the fact that the hoisting cable is guided over cable pulleys which are connected to the end of the compensator, all the above in such a way that force can be exerted upon the hoisting cable with the aid of the compensator.

That means that the compensator is no longer placed between the trolleys which are attached to the mast, but that the compensator acts directly upon the hoisting cable. The compensator can be connected by a first end to a stationary section of the mast. At the other end, the compensator is connected to the hoisting cable by way of cable pulleys. Tension can thus also be applied to the hoisting cable by means of the compensator.

The advantage of these measures is in the first place that the compensator can be fastened in a fixed position in the vicinity of the mast. The connection of the compressed air device to the compensator can therefore be made a t one point. That makes a relatively simple and cheap construction possible.

The hoisting device according to the invention can be improved further by the device comprising at least two compensators, each of which is connected to cable pulleys at its end.

The effect of this measure is that the device acquires greater redundancy. If the compensator in a device according to the prior art breaks down, the drilling operations must be stopped immediately With a hoisting device according to the invention, containing more than one compensator, it is possible to continue working should one of the compensators break down. The cylinder of the compensator which fails is locked in that case. Locking the compensator will mean that the stroke of the bottom trolley is reduced, but because one or more compensators that are still active remain, the device does not have to be shut down.

It is advantageous according to the invention for the mast to be designed in the form of a tube or sleeve, and for the compensator(s) to be place in the mast.

BRIEF DESCRIPTION OF THE DRAWINGS

The present invention will be described further with reference to the appended drawings, in which.

DETAILED DESCRIPTION

Figure 1:
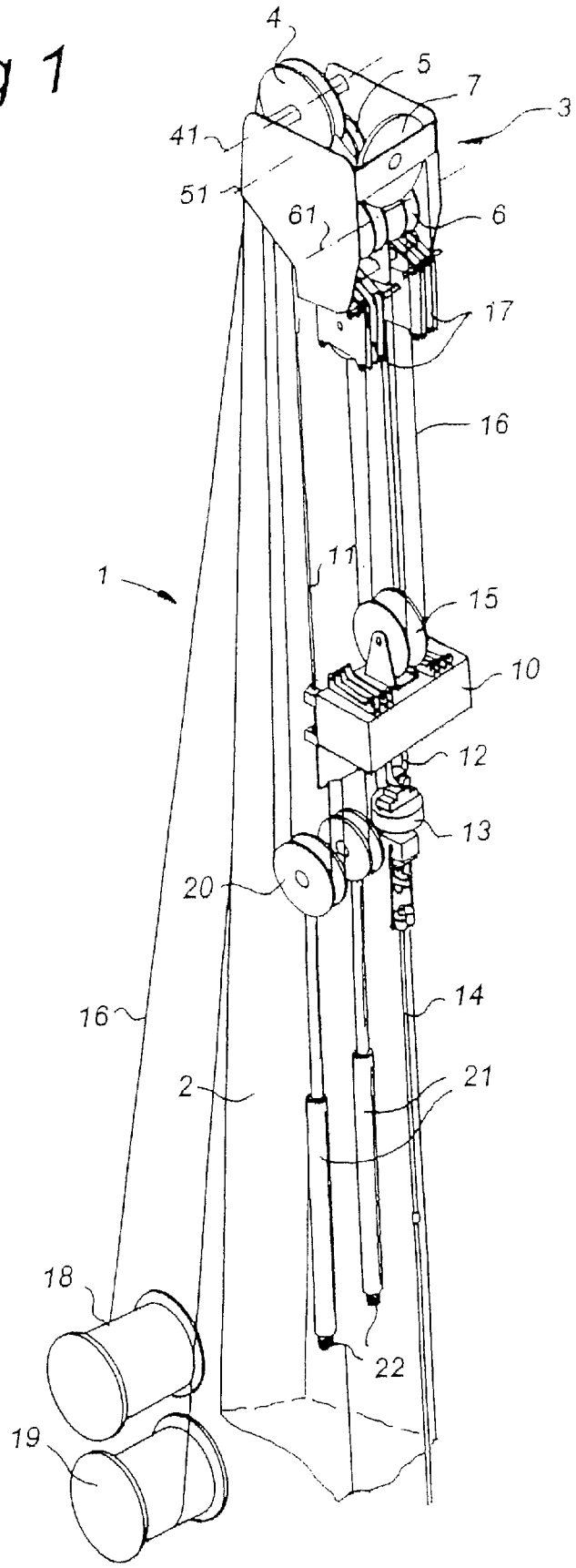
FIG. 1 shows the hoisting device according to the present invention.

There is generally sufficient space in the mast on a drilling vessel or a comparable vessel for placing the compensator. That means that the compensator itself will not require any additional space. In addition to the advantage of the space gain achieved, it is important that the mast remains readily accessible from all sides through the placing of the compensator in the mast. The compensator thus does not constitute any obstacle to, for example, the supply of equipment to the mast.

In the devices according to the prior art it is customary for a hoisting cable to be attached to a fixed point at one end. The other end of the hoisting cable is then wound around a winch. If this winch breaks down, it is no longer possible to work with the device.

It is therefore advantageous for the hoisting means to be provided with two winches, each end of the hoisting cable being wound onto a separate winch. By now winding the two ends onto a separate winch, it is possible to achieve the same cable speed at a relatively low speed of revolution of the winches. That means an enormous reduction in the wear on the cable, with the result that the cable does not have to be replaced as often.

Moreover, by adding the second winch, redundancy is provided in the system. Should one of the winches fail, then the hoisting device is not unusable, but it is possible to continue working with a single winch. It is advantageous for the winches to be driven by a plurality of relatively small motors.

For example, it is possible to equip the winches on both sides with electric motors which engage with a pinion in a toothed wheel of the winch. First, this has the advantage that such electric motors are commercially available. For the use of the hoisting device it is therefore not necessary to develop a special, and therefore expensive, hoisting winch. Secondly, the relatively small motors have a low internal inertia, which means, for example, that when the direction of rotation of the winch is reversed less energy and time are lost during the reversal.

In the case of a hoisting device according to the prior art of the type mentioned in the preamble, finding the optimum compromise between speed and power is a known problem. The hoisting cable is guided in such a way over the cable blocks in the mast and on the trolley that several cable parts extend between the mast and the trolley. In this case the more wire parts are present between the mast and the trolley, the greater will be the load that can be lifted with the hoisting device if the hoisting winch remains unchanged. However, in this case the more wire parts are present between the mast and the trolley, the lower will be the speed at which the trolley can be moved relative to the mast.

In order to find a good compromise between speed and lifting power, it is generally decided to provide the hoisting device with relatively heavy winches. The heavy winches ensure that the requirement of being able to move the trolley up and down rapidly can be met in every case. However, that also means that a substantial part of the lifting power is not being utilized for a substantial part o f the time. In other words, the device is actually provided with too heavy—and therefore too expensive—winches to be able to reach sufficient speed occasionally.

It is therefore a further object of the present invention to provide a hoisting device of the type mentioned in the preamble. By means of which, on the one had, a relatively heavy load can be lifted and on the other hand, which can be operated at a relatively high speed, while the hoisting means can be of a relatively light and cheap design.

The object is achieved in the present invention by the fact that the hoisting cable is also guided over loose pulleys, which can be moved between a first position, in which the loose pulleys are connected to the mast, and a second position, in which the loose pulleys are connected to the trolley.

The effect of this measure is that the number of wire parts between the mast and the trolley can be set as desired. When the loose pulleys are attached to the mast, few wire parts will extend between the mast and the trolley, and a relatively low weight can be lifted. When the loose blocks are attached to the trolley, a relatively large number of wire parts will extend between the mast and the trolley, and the trolley can be moved a t a relatively low speed relative to the mast. Since the hoisting cable is guided over the pulleys and the pulleys can be attached as desired to the mast or to the trolley, the hoisting cable does not have to be reeved again. That means that the desired number of wire parts can be set in a relatively short time.

It is possible according to the invention for the loose pulleys to be attached symmetrically relative to the center of the mast.

This ensures that the forces exerted upon the cables are also transmitted symmetrically to a mast, which means that no additional bending loads are exerted upon the mast.

It is possible according to the invention for the loose pulleys to be accommodated in a housing, which at least on the bottom side is provided with locking elements for fixing the pulleys on the trolley. The loose pulleys are pulled automatically into their first position, in contact with the mast, by tension in the hoisting cable. It is therefore sufficient to provide the bottom side of the pulleys with locking elements.

It is advantageous for the locking elements to be equipped with a hydraulic actuation device. The use of a hydraulic actuation device means that the locking pins can be remotely controlled.

The hoisting device according to the invention is further improved by the fact that the hoisting device is provided with a connecting cable, for connecting the vessel to a stationary section, such as the top side of the riser, which connecting cable is guided over the cable pulleys connected to the end of the compensator, in order to be able to exert a force upon the compensator with the connecting cable.

The term 'stationary section' according to this description is intended to convey a section which forms part of or is connected to the seabed.

The connecting cable will be fitted in such a way that when the vessel moves upwards relative to the seabed, additional force is applied to the compensator, so that its length increases. The pulleys connected to the compensator consequently move to the topside of the mast, so that a load connected to the hoisting cable will move downwards. When the vessel moves downwards, the opposite occurs. Since the connecting cable is connected to a stationary section, the load itself will not move relative to the seabed. The heave can be compensated for entirely with the aid of the connecting cable. It is obvious to connect the connecting cable to the topside of the riser. In that case the connecting cable could also e called a "riser connect winch.

It is further possible for each end of the connecting cable to be wound onto a separate winch".

It is further advantageous to provide one of the winches with a slip brake, for paying out the connecting cable when a maximum pulling force in the connecting cable is exceeded. The slip brake ensures that a maximum pulling force can be applied to the connecting cable if that is desired in use. If the force on the cable becomes higher, the winch will pay out the cable so that the pulling force does not exceed the previously set value.

It is further advantageous for the connecting cable also to be guided over loose pulleys, which are movable between a first position, in which the loose pulleys are connected to the mast, and a second position, in which the loose pulleys are connected to the stationary section, such as the top side of the riser.

For good functioning of the heave neutralization by means of the connecting cable, the working length of the connecting cable must be adapted to the working length of the hoisting cable. That means that the moment the number of parts of the hoisting cable between the mast and the trolley is changed, it must also be possible to change the number of parts of the connecting cable between solid ground (riser) and the mast.

According to the invention, it is further possible for the mast to be provided at the topside, on both sides of the hoisting cable, with a fastening for attaching a pull rod or pull cable. These fastenings can each be used for coupling a pull rod, for example a drill pipe, which pull rods are connected by means of a clamp at the bottom side. Said clamp can be used for clamping, for example, the drill string. This produces in a simple and advantageous manner a system that ensures that a load can be attached to the mast, while the hoisting block above the load is free for carrying out hoisting operations.

The present invention in a second aspect relates to a method, by means of a passive compensator, for placing an object on the ground.

The method according to the present invention is characterized in that: the compensator is placed under a tension that is equal to the underwater weight of the object that has to be taken downwards by the hoisting device, the object is moved downwards by paying out the hoisting cable with the aid of the winch, the hoisting cable continues to be paid out until the object makes contact with the bottom. At that moment a switch-over is made to the low gas pressure system, the object now remains standing on the seabed at a previously set gas pressure.

In the manner described above it is possible for a heavy object to be place in a very controlled manner on the ground beneath a vessel. The danger of an object hitting the ground with great force and consequently being damaged is minimized in this way.

FIG. 1 shows the hoisting device 1 according to the present invention. The hoisting device 1 comprises a mast 2. In the description below the term mast will always be used, but it must be understood that any other suitable device, such as, for example, a tower, could also be used.

The topside of the mast 2 is formed by a masthead 3. A large number of cable pulleys are fixed in the masthead 3. First, two cable pulleys 4 are fitted on an axis 41. Below that, on the rear side of the mast, four cable p pulleys 5 are mounted on an axis 51. On the front side of the mast, four cable pulleys 6 are mounted on an axis 61. Furthermore, a middle pulley 7 is fixed on the front side of the mast, the axis of said pulley 7 being substantially perpendicular to the axis of the pulleys 4, 5, and 6.

The hoisting device further comprises a trolley 10. Said trolley 10 can move along a guide 11 relative to the mast 2. On the bottom side, the trolley 10 is provided with a bracket or hook 12, or some other suitable means, to which a load to be hoisted can be attached. FIG. 1 shows the case in which a top drive 13 with a drill string 14 fixed below it is attached to the hook 12. On the top side, the trolley 10 is provided with two cable pulleys 15. The trolley 10 is connected to the mast head 3 by the cable 16, which runs by way of several reevings between the cable pulleys 15 on the trolley and the various cable pulleys in the mast head 3.

In addition to the above mentioned cable pulleys 4, 5, 6, 7 and 15, four "loose pulleys" 17 are also present in the hoisting device 1. These loose pulleys 17 may be attached as desired to the mast head 3 or to the trolley 10. The coupling of the loose pulleys 17 to the mast head 3 or to the trolley 10 is shown in detail in FIGS. 4–9.

The advantage of the presence of the loose pulleys 17 is that the number of wire parts of the cable 16 that extend between the mast head 3 and the trolley 10 can be varied. If the loose pulleys 17 are attached to the mast head 3, a limited number of wire parts will extend in the direction of the trolley 10. That means that, on the one hand, a relatively limited weight can be lifted with he aid of the hoisting device, but, on the other hand, the trolley 10 can be moved relatively quickly in the direction of the mast head 3. If the loose pulleys 17 are attached to the trolley 10, a relatively large number of wire parts will extend from the mast head 3 in the direction of the trolley 10. That means that a relatively great weight can be lifted with the aid of the trolley 10, but that said trolley 10 will be moved at a relatively slow speed relative to the mast head 3. By distributing the number of loose pulleys 17 as desired over the mast head 3 and the trolley 10, it is ensured that both the weight to be lifted with the hoisting device and the speed at which the trolley 10 can be moved relative to the mast head 3 are adjustable.

In the prior art a known problem is that a hoisting device often has to be equipped with a relatively large drive, in order to be able to achieve a workable compromise between the maximum lifting power and the minimum speed to be achieved. This problem is solved by the "loose pulleys" according to the present invention.

In the hoisting device 1 according to FIG. 1 the cable 16 extends from a first hoisting winch 18 in the direction of the mast head 3. The hoisting winch is also known as a draw work. The hoisting cable 16 is subsequently guided back to a second hoisting winch 19. In the prior art it is customary for an end section of the hoisting cable 16 to be fixed at a fixed point, the other end being rolled up on a hoisting winch. Several advantages can be obtained by making use of two hoisting winches 18, 19, as in the hoisting device 1. In order to achieve a certain speed of the trolley relative to the mast head 3, the speed of rotation of the hoisting winches 18 and 19 can be kept twice as low as it could if only one hoisting winch were used. The effete that can be obtained by keeping the speed of the hoisting winches 18, 19 relatively low is that little wear will occur in the cable 16. Should one of the two hoisting winches fail during use, work can continue using another hoisting winch. In the prior art the failure of a hoisting winch immediately means that the hoisting device can no longer be used. The hoisting winches 18, 19 are preferably driven by electric motors. In the case of each hoisting winch, for example, each side of the hoisting winch 18, 19 can be provided with such a motor. That means that each hoisting winch is driven by 2 electric motors. First, this has the advantage that the electric motors to be used can be kept relatively small, which means that these motors do not have to be designed specifically for the hoisting purposes, but will be in stock on the market. Secondly, the use of the relatively small motors has the effect that the internal inertia in the motors is kept low. That means that when the direction of rotation of the winches 18, 19 is reversed the internal inertia of the drive elements themselves will not give rise to problems.

In FIG. 1, in addition to the cable pulleys mentioned, there is further a first set of two and a second set of two cable pulleys 20, connected to the top side of two compensators 21, The compensators 21 are connected at the bottom side in the connection point 22 to the mast 2. The hoisting device 1 according to the present invention can advantageously be used for numerous hoisting operations. The hoisting device 1 is particularly advantageous when used in the case of drilling operations, from a vessel. The reason for this is that, particularly in the case of such drilling operations, in some parts of the drilling processes has to be possible for a very great hoisting force to be applied, and that in other parts of the drilling process the speed at which the trolley can move relative to the mast in the most important factor. In the case of hoisting devices which are used on such drilling vessels, it is common to place a compensator in the device. Said compensator is generally fitted on the bottom side of the trolley 10. A device is then place on the bottom side of the compensator, to which device, for example, the top drive of a drill string can be connected. By means of such a fastening of the compensator, the compensator will move relative to the mast. For good functioning, the compensator must be connected to supply means for compressed air. When the compensator moves relative to a mast, this compressed air installation must be connected in a complex—and therefore relatively expensive—manner to the compensator, for example by means of flexible hoses and the like.

According to the invention, it has now been decided to fit the compensators 21 in the mast 2, in which case the bottom side 22 of the compensators will be attached to a stationary point of the mast 2. The position of the bottom side of the compensators relative to the mast is therefore the same at all times. That means that the installation for supplying air pressure can always be connected to the compensators 21 at the same point. This ensures that the coupling between the air pressure installation and t h e compensators can be made many times simpler that is the case in the prior art.

Two compensators 21 are deliberately illustrated in the mast. The device 1 can function extremely well with only one compensator 21, but the addition of at least a second compensator is advantageous. Should one of the two compensators fail to function or break down, it is still possible to go on working with the aid of the device. In the prior art the breakdown of the compensator meant immediate stoppage of the hoisting device. That is prevented with the invention.

The hoisting device according to FIG. 1 is further provided with a connecting cable, which provides for a connection between solid ground and the pulleys 20 which are connected to the compensators 21. The connecting cable is omitted in FIG. 1 in order to keep the drawing clear to view. The functioning of the connecting cable is explained with reference to FIG. 3.

Figure 2:
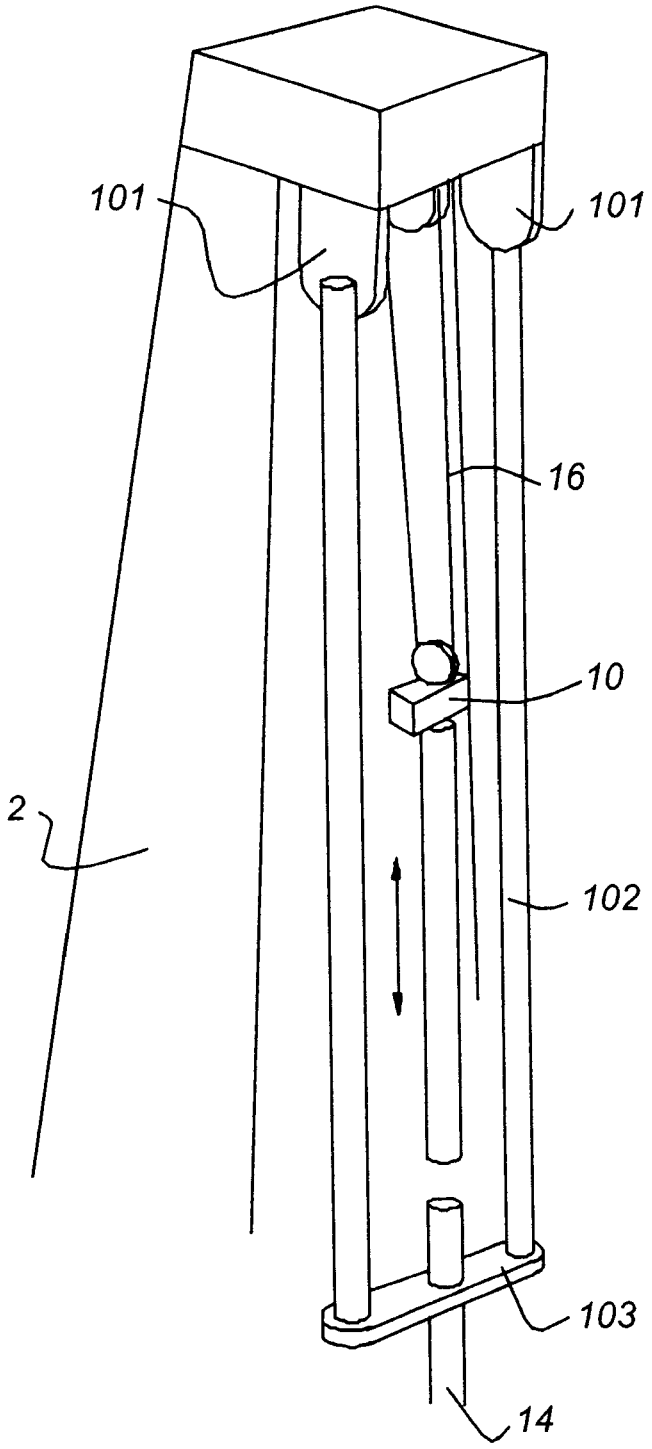
FIG. 2 shows a diagrammatic view of the fastening of the rods as described on page 10, lines 26–34.

The mast according to FIG. 1 is illustrated diagrammatically in FIG. 2. The mast 2 is provided with fastenings 101 on the top side. These fastenings 101 can each be used for connecting a pull rod, for example a length of drill pipe 102, which pull rods are connected at the bottom side by means of a clamp 103. Said clamp 103 can be used for clamping, for example, the drill string 14, at a moment when the drill string does not need to move up and down with the aid of the trolley 10. This is a simple and advantageous way of producing a system which ensures that a load can be attached to the mast 2, while the hoisting block 10 above the load is free for carrying out hoisting operations.

Figure 3:
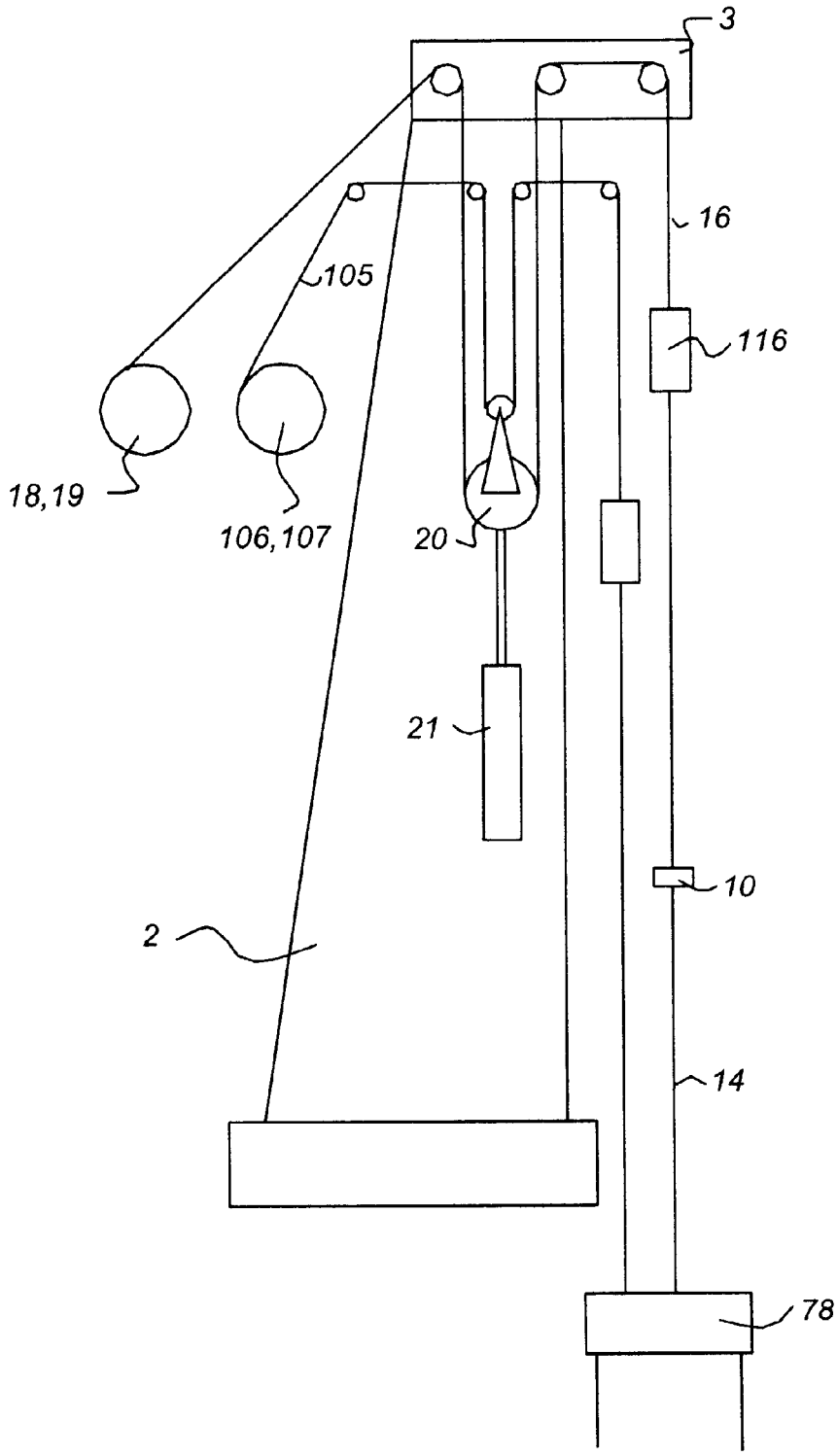
FIG. 3 shows a diagrammatic view of the operation of the riser connect winch via the compensator to the riser.

FIG. 3 shows a diagrammatic side view of the drill mast according to FIGS. 1 and 2. In addition to the hoisting cable 16, the connecting cable 105 can also be seen. This connecting cable 105 is guided over the cable pulleys 20, which are connected to the end of the compensator 21. The object of this is to be able to exert a force on the compensator 21 with the connecting cable 105. The presence of the connecting cable 105 means that there is a connection between the pulleys 20 and the seabed, or a section that is connected to the seabed.

The connecting cable 105 will be fitted in such a way that when the vessel moves upwards relative to the seabed, additional force is exerted upon the compensator 21. This makes the compensator 21 longer. The pulleys 20 connected to the compensator 21 move in the direction of the mast head 3. This releases a section of the hoisting cable that was clamped in the mast 2 between the top side of the mast and the pulleys 20, so that a load connected to the hoisting cable 16 moves downwards. When the vessel moves in the direction of the seabed, the opposite occurs. Since the connecting cable 105 is connected to a stationary section, the load itself will not move relative to the seabed. The heave can be compensated for completely with the aid of the connecting cable.

It is also possible foe each end of the connecting cable 105 to be wound onto a separate winch 106, 107. In use, it is advantageous if the connecting cable can either be hauled in/paid out very quickly or the hauling in of the cable can be carried out with great force. The placing of the connecting cable 105 in position and the operation of the winches 106 and 107 are explained with reference to FIGS. 13*a*–13*e*.

The possibility of varying the number of hoisting parts between the mast head 3 and the trolley 10 is built into the system of the hoisting cable 16. This possibility is discussed in detail with reference to FIGS. 4–9. For good functioning of the heave neutralization by means of the connecting cable 105, the working length of the connecting cable 105 must be adapted to the working length of the hoisting cable 16. In other words, the moment the number of parts of the hoisting cable 16 between the mast 2 and the trolley 10 is changed, it must also be possible to change the number of parts of the connecting cable 105 between solid ground (riser) 78 and the mast 2.

Figures 4, 5, 6:
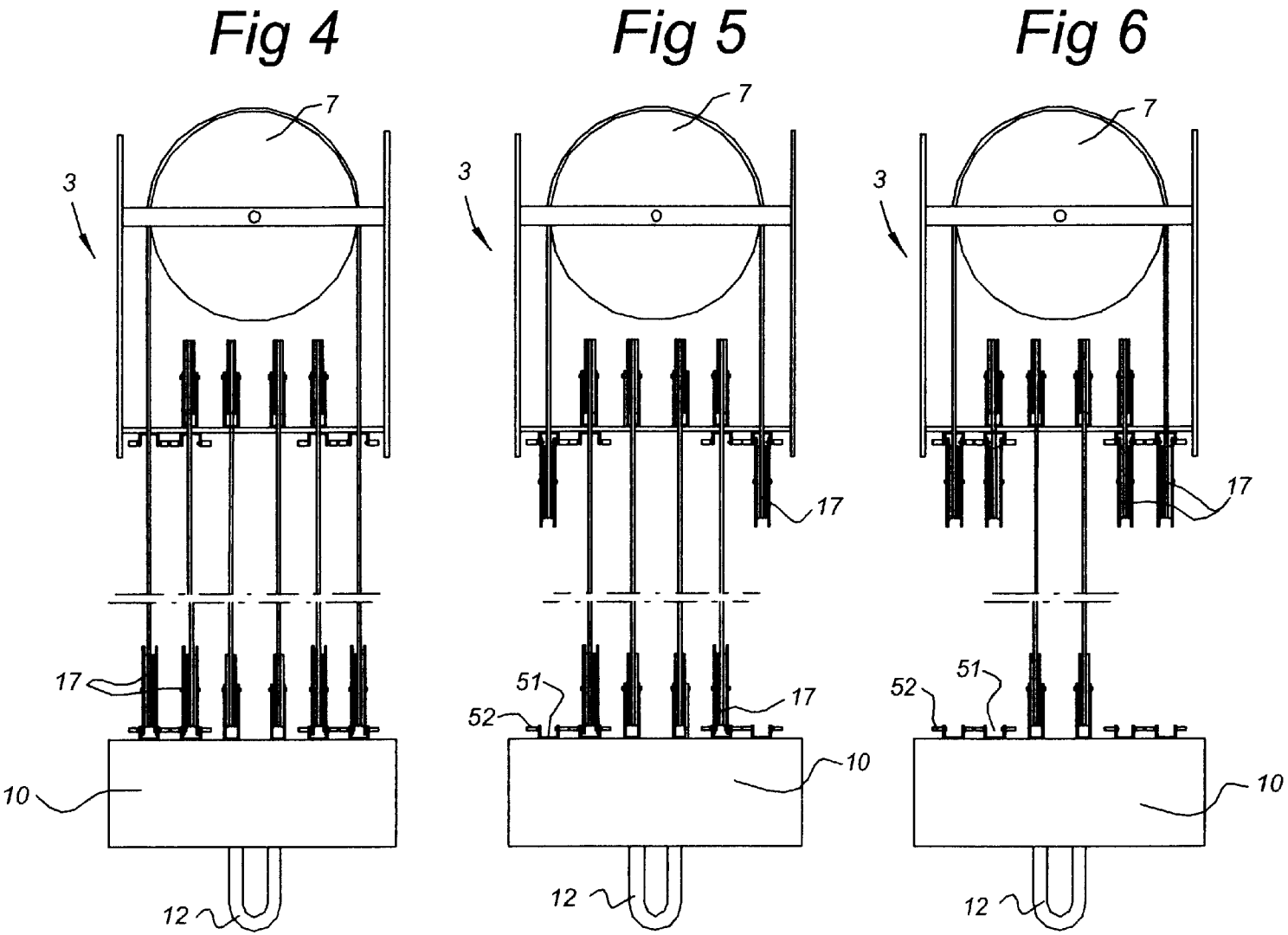
FIG. 4 shows the case where four loose pulleys are attached to the trolley.
FIG. 5 shows the case where two loose pulleys are attached to the trolley and two loose pulleys are attached to the mast head.
FIG. 6 shows the case where four loose pulleys are attached to the mast head.

FIG. 4 illustrates the case where four loose pulleys 17 are attached to the trolley 10. It can be seen in FIG. 4 that four pulleys 17 are attached to the trolley 10. This means that twelve wire parts extend between the trolley 10 and the mast head 3.

FIG. 5 shows the case where two loose pulleys 17 are attached to the mast head 3 and two loose pulleys 17 are attached to the trolley 10. In this case eight wire parts will extend between the mast head 3 and the trolley 10.

FIG. 6 shows the case where four loose pulleys 17 are attached to the mast head 3. That means that only 4 wire parts will extend between the mast head 3 and the trolley 10.

As will be understood, the highest weight can be lifted in the configuration according to FIG. 4, since in that case twelve wire parts extend between the mast head 3 and the trolley 10. In the configuration according to FIG. 6 relatively little weight can be lifted since only four wire parts extend between the mast head 3 and the trolley 10. However, the trolley 10 can be moved at a relatively high speed relative to the mast head 3.

It can be seen in FIGS. 4, 5 and 6 that on the left-hand side of the mast 2 exactly the same number of loose pulleys 17 are attached to the mast head 3 as on the right-hand side. That means that the forces of the cable 16 on the mast will be distributed symmetrically.

Figure 7A:
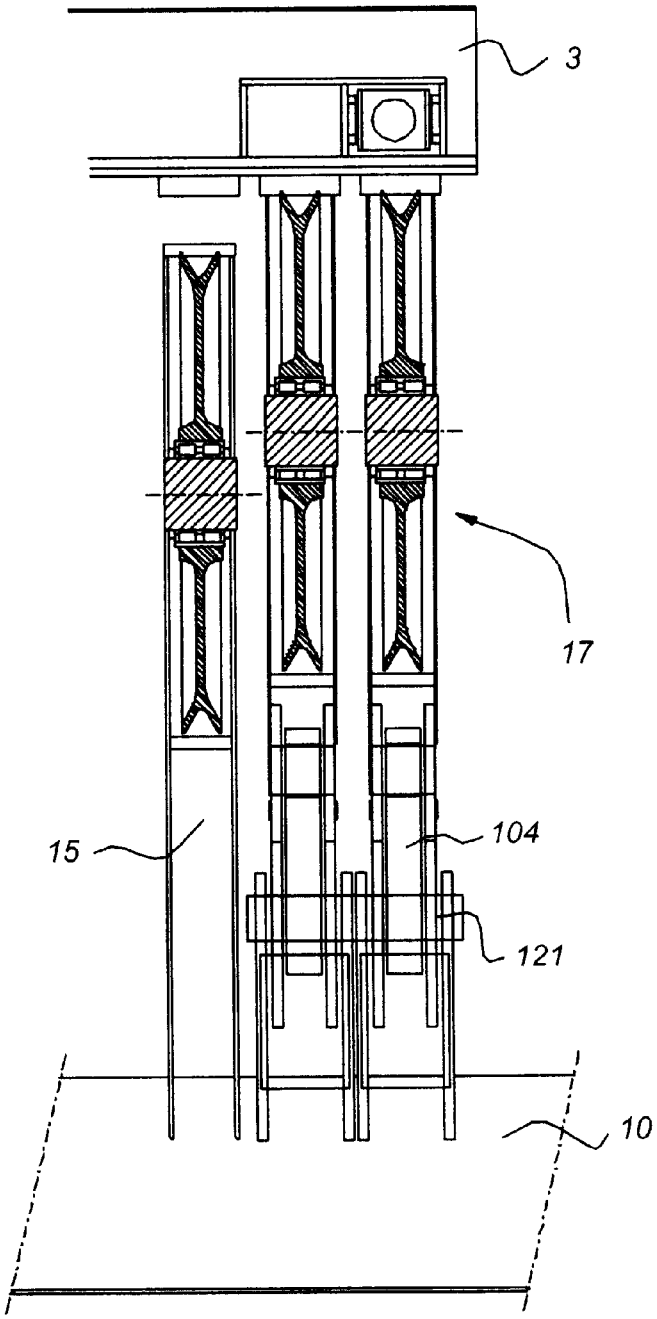
FIG. 7A–7B shows a front view of a possible embodiment of the loose pulleys.
Figure 7B:
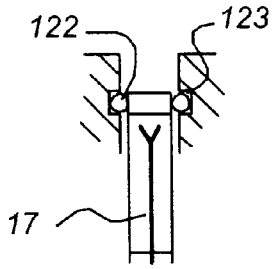

FIG. 7A shows a front view of a part of the trolley 10, with a fixed pulley 15 and loose pulleys 17 thereon. The block will be designed symmetrically, with loose pulleys 17 being placed on both sides of the fixed pulley (only two pulleys 17 are illustrated in the figure). On the bottom side, the loose pulleys 17 are provide with a lock or hook 104 which interacts with a lug or pin 121 on the trolley 10. The pulleys 17 can be fixed on the trolley as desired. Since there will always be a certain tension on the hoisting cable 16, the loose pulleys 17 are pulled automatically in the direction of the mast head 3. For that reason, fastening means can be dispensed with on the top side of the pulleys 17. However, if the tension is lost completely, a pulley 17 will fall downwards by the force of gravity. In order to be on the safe side, the hoisting device is therefore provided with a safety facility, which can be as designed in, for example, FIG. 7B. According to FIG. 7B, a pulley 17 is provided on its top side with two balls which are connected to the housing of the pulley 17 in such a way that they are movable relative to each other. The balls are accommodated in recesses 123 in the mast head 3. If no force at all is exerted upon the pulley 17, the force with which the balls lock the pulley in the mast head is sufficient to hold the pulley 17 in place. However, if a slight force is exerted upon the pulley, the balls are released from the recesses, and the pulley 17 can the move downwards.

Figure 8:
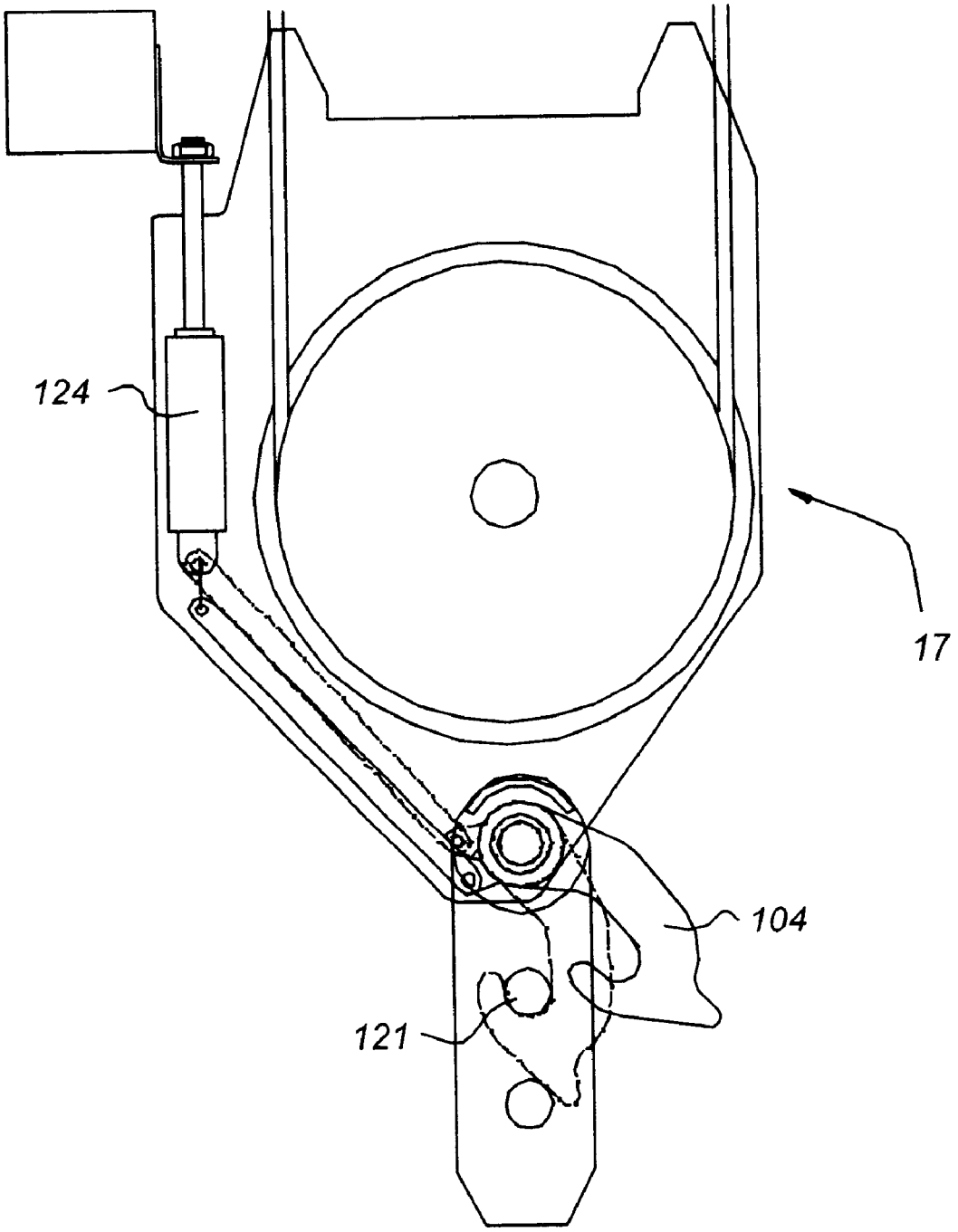
FIG. 8 shows a side view of one of the loose pulleys according to FIG. 7A.

FIG. 8 shows a side view of one of the loose pulleys 17 according to FIG. 7A. The lock 104 is shown in two positions. The position of the lock is determined with the aid of a cylinder 124. When the cylinder is not actuated, the lock falls behind the pin 121 during to-blocks pulling (see above). The pulley 17 is thus connected to the trolley 10. When the trolley 10 during use is move relative to the mast head 3, the trolley 10 takes that loose pulley 17 along with it downwards. If, on the other hand, the cylinder is actuated, the hook cannot grip behind the pin 1221, and that means that the trolley 10 cannot take the pulley along with it, so that the pulley 17 remains behind in the mast head 3.

The cylinder 124 by means of which the lock 104 is operated has been deliberately placed in the mast head 3. The fact is that the trolley 10 goes into the so-called Hazardous Area on a drilling platform or vessel. During the drilling, gas or oil can escape in this area. Non-explosive equipment must be worked with in the Hazardous Area. For that reason, it has advantages to place the cylinder 124 on /in the mat head 3.

Figure 9:
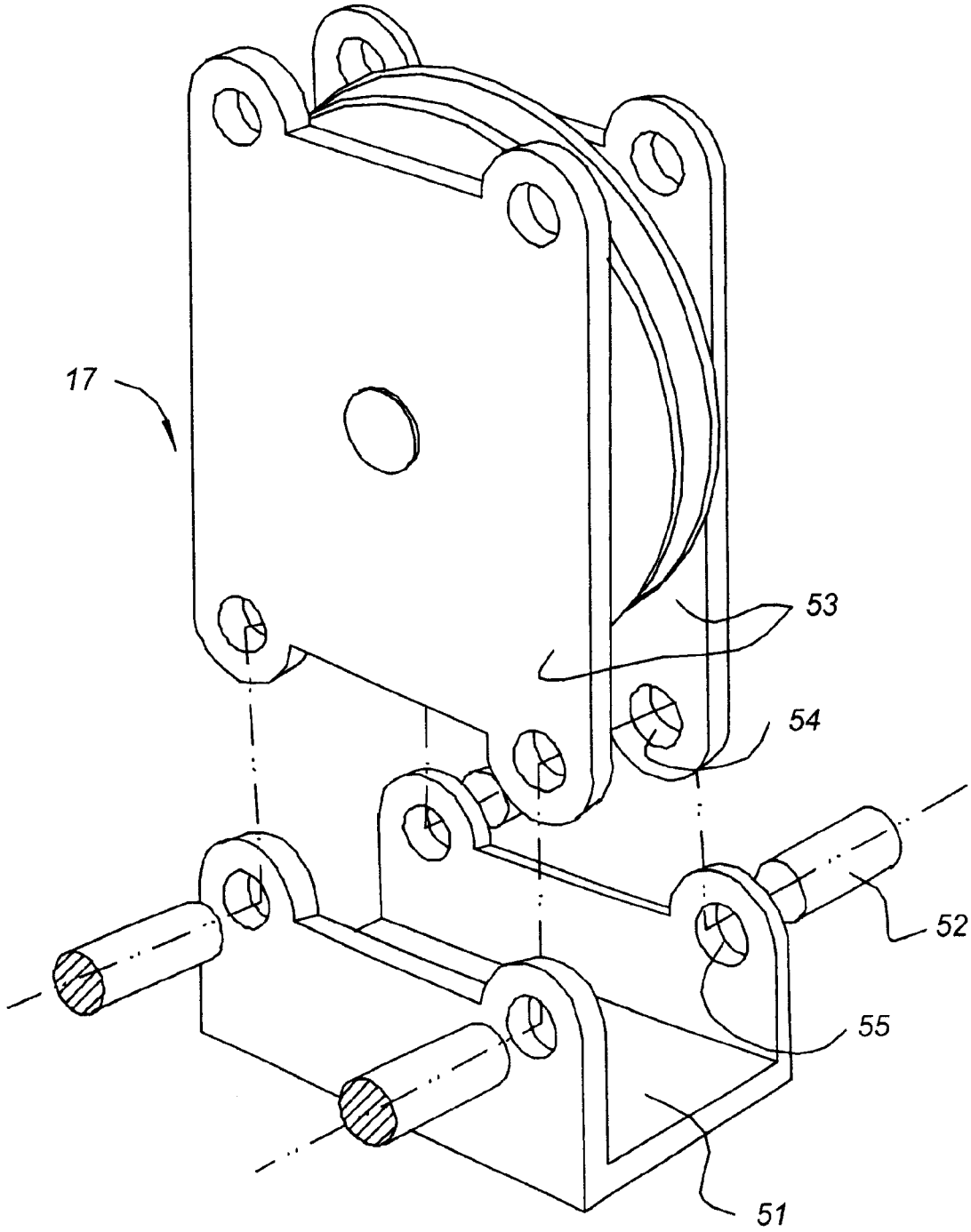
FIG. 9 shows a second embodiment of loose pulley.

FIG. 9 shows a further embodiment of the loose pulley 17, the loose pulley 17 comprises an outer housing consisting of two plates 53. Both on the top side and on the bottom side, these plates 53 are provided with eyes 54, in which locking pins are received. Said locking pins move through eyes 55, which are cut out in, for example, a U-shaped fastening element 51. This fastening element 51 can be attached either to the trolley or to a mast head. In use, the trolley 10 will be hoisted to a position as close as possible to the mast head 3. This position is also known as to-blocks. After that, either the locking pins 52 belonging to the trolley 10 or the locking pins 52 belonging to the mast head 3 will be moved into the eyes 54 of the plates 53. In this way a choice can be made concerning which loose pulleys 17 are connected to the mast head 3 and which pulleys 17 are connected to the trolley 10.

Figure 10:
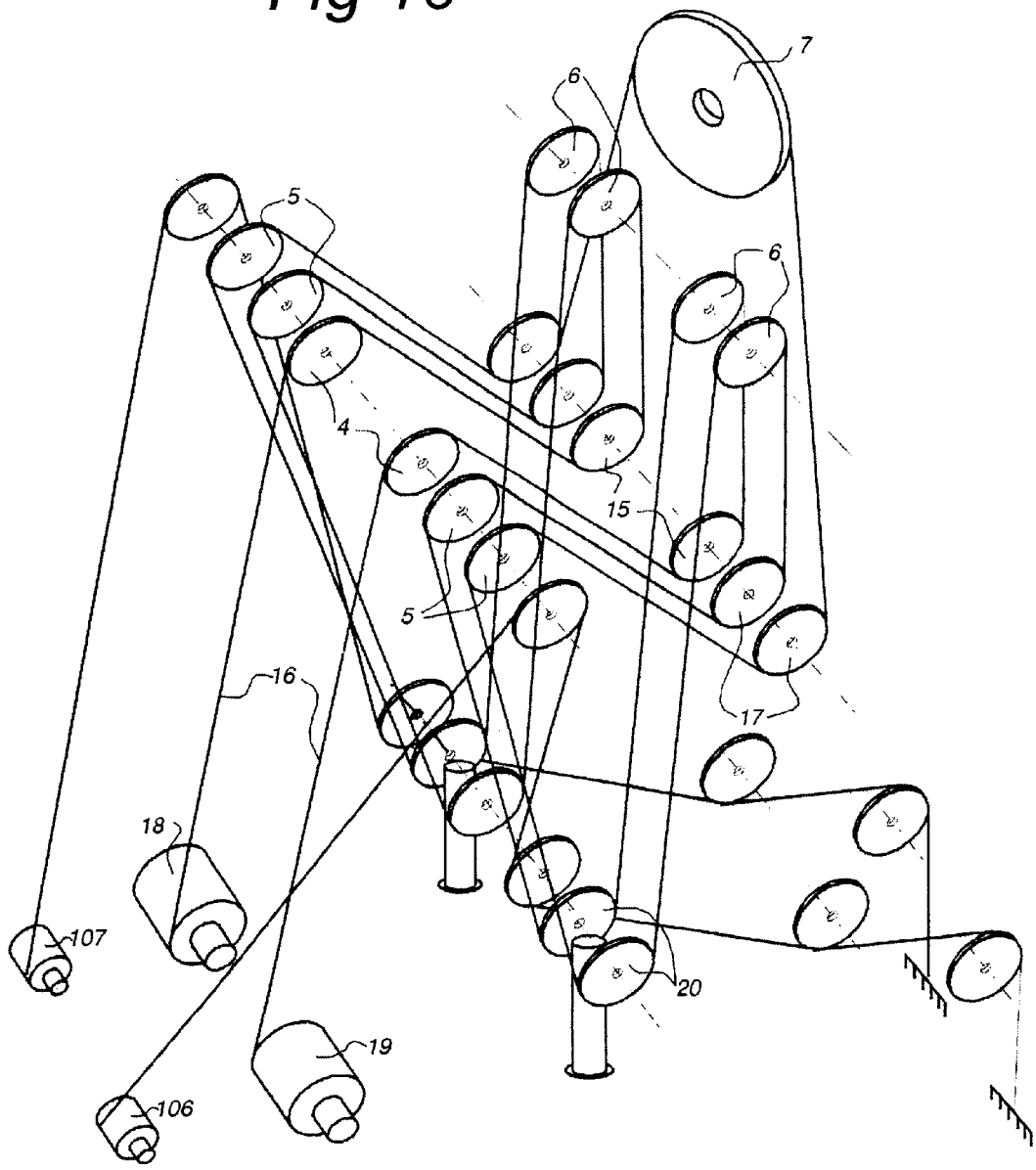
FIG. 10 shows diagrammatically the run of the hoisting cable over the various pulleys, in the case where four loose pulleys are attached to the trolley.

FIG. 10 shows the run of the cable 16 from the hoisting winch 18 over the successive cable pulleys in the direction of the hoisting winch 19. FIG. 10 shows the case where the four loose pulleys 17 lie substantially in line with the two pulleys 15 which are immovably fixed to the trolley. That means that in the case shown in FIG. 10 twelve wire parts will extend between the mast head 3 and the trolley 10.

Figure 11:
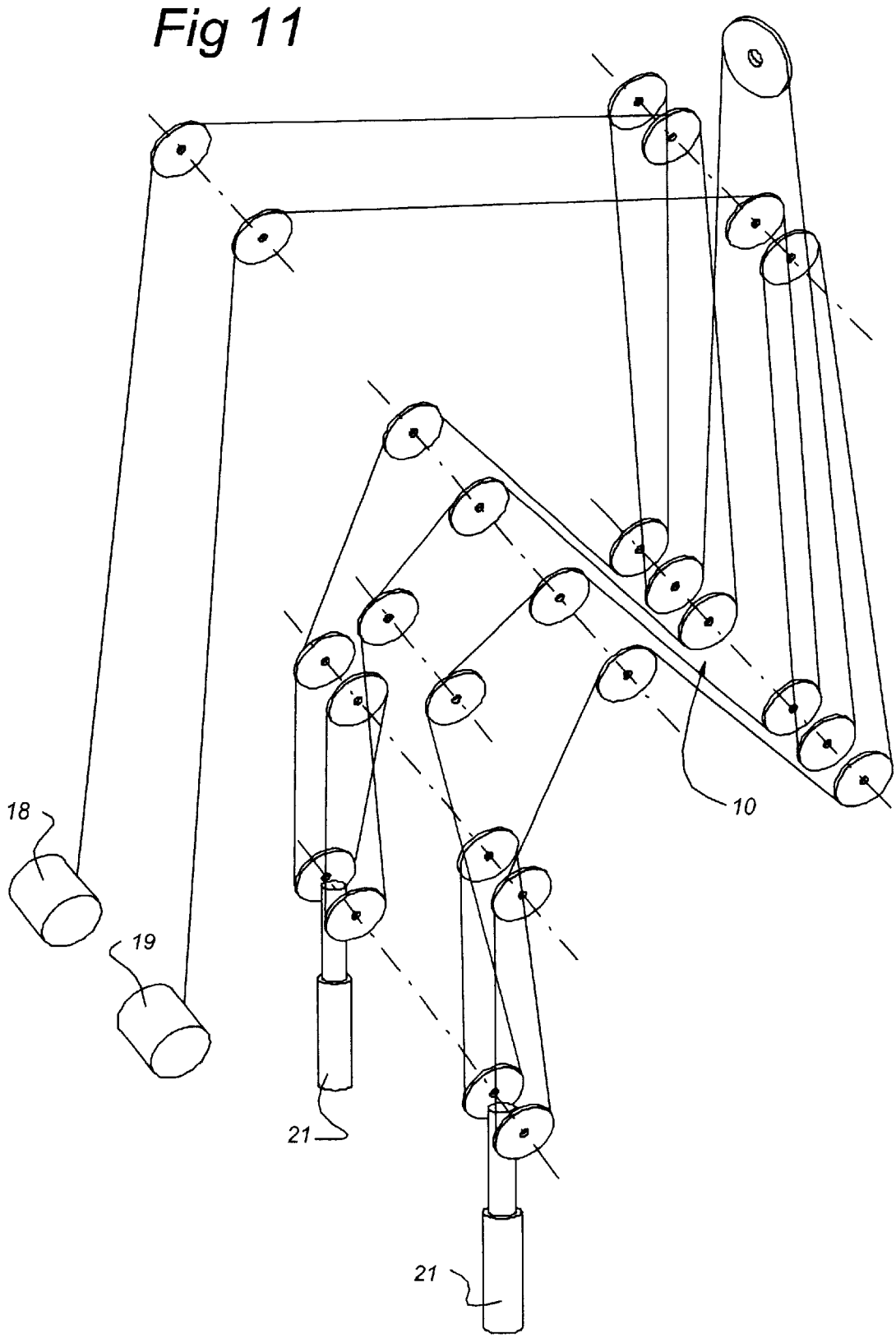
FIG. 11 shows diagrammatically a second possibility for reeving the hoisting cable.

FIG. 11 shows a further reeving plan for the hoisting cable 16 which can be used for the device according to the invention.

Figure 12A:
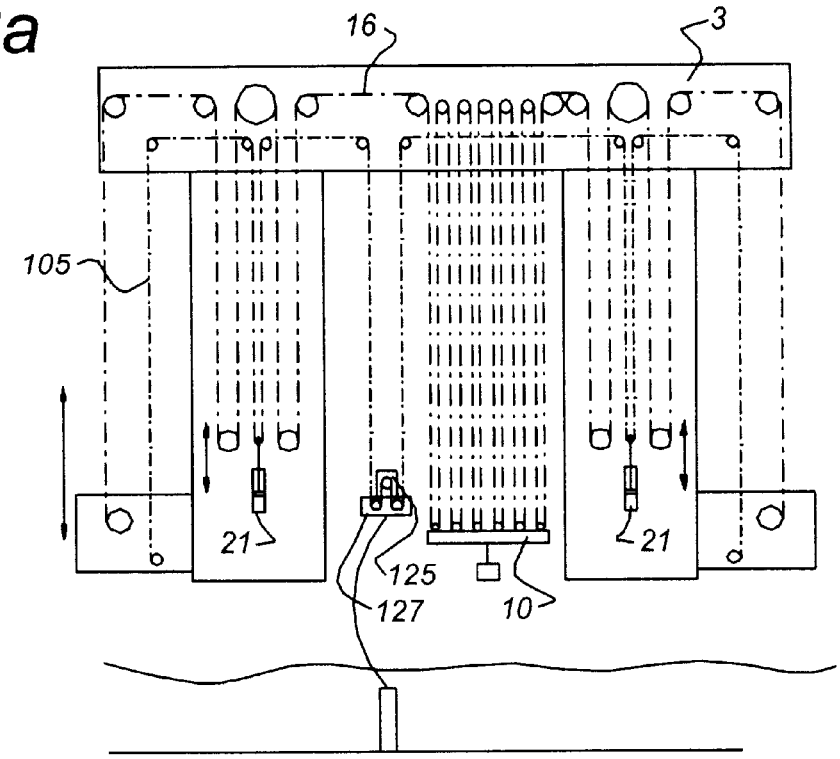
FIGS. 12*a*, 12*b* and 12*c* show the relationship between the number of parts of hoisting cable between the mast head and the trolley, on the one hand, and the number of parts of connecting cable between the mast head and solid ground, on the other hand.
Figure 12B:
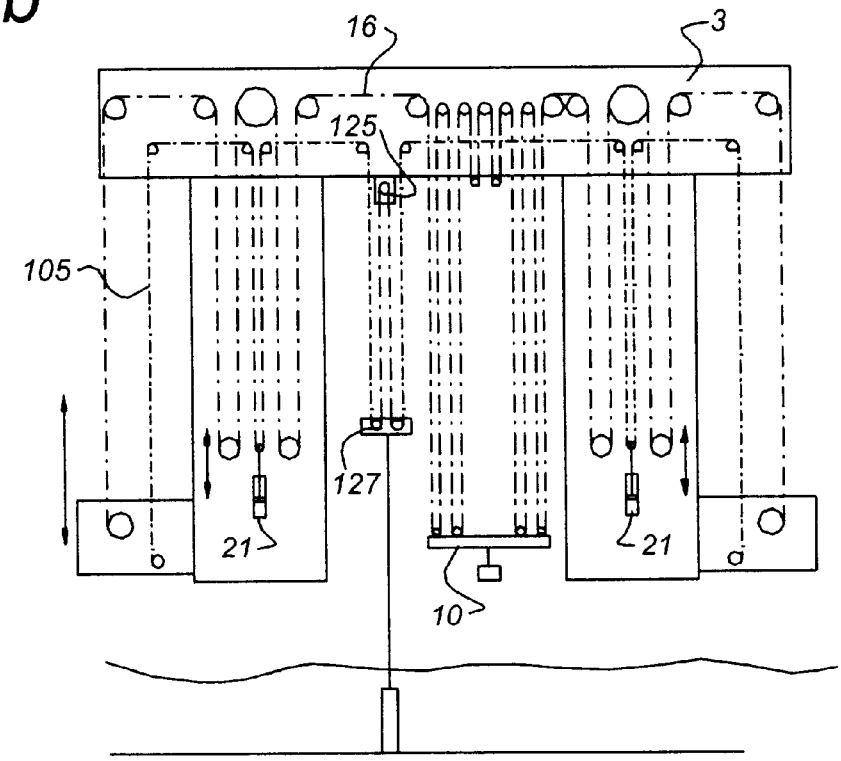
Figure 12C:
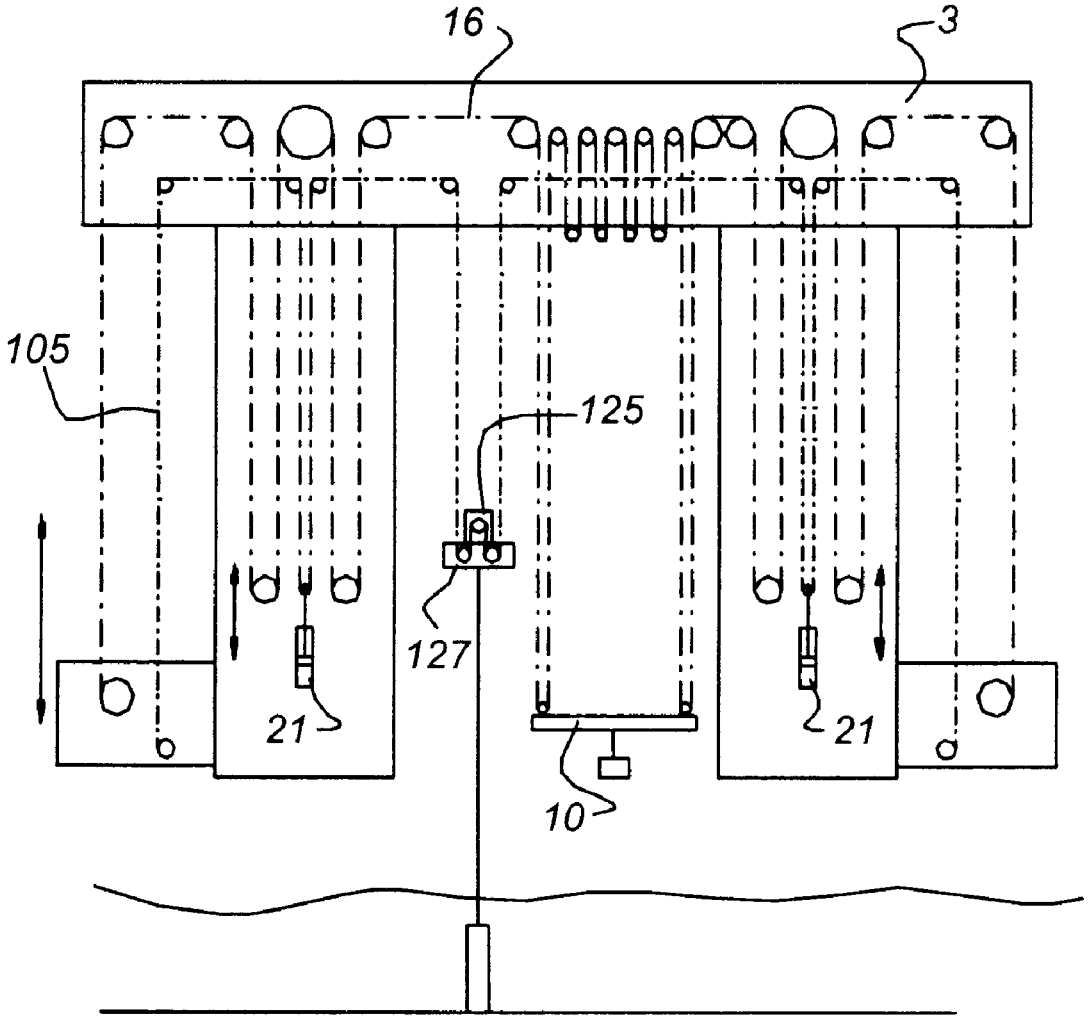

In FIGS. 12*a*–12*c* the setting of the correct number of hoisting parts in the hoisting cable 16 and the connecting cable 105 respectively is illustrated further. It can be seen in the figures that the connecting cable is guided over at least one loose pulley 125. Said loose pulley 125 is movable between a position in contact with the mast head 3 (see FIG. 12*b*) and a position in which the loose pulley 125 is situated in the vicinity two further pulleys 127, which guide a further part of the connecting cable (FIGS. 12*a* and 12*b*).

According to FIG. 12*a*, there are twelve hoisting parts in use between the mast head 3 and the trolley 10. This large number of hoisting parts in the hoisting cable 16 is generally used only during the placing of the riser and the BOP (see FIGS. 15–18). In that case the riser connect winch is not needed. It can therefore be seen in FIG. 12*a* that the connecting cable 105 is not being used in this case.

According to FIG. 12*b*, there are eight hoisting parts in use between the mast 2 and the trolley 10. In this case the loose pulley 125 over which the connecting cable 105 is being guided is in contact with the mast head 3. Between said mast head 3 and the fastening of the connecting cable 105 to solid ground (riser 78) there are four parts in use.

According to FIG. 12*c* there are only four hoisting parts present between the mast head 3 and the trolley 10. In this case the loose pulley 125 is connected to the remaining pulleys 127.

FIGS. 13*a*–13*e* show stepwise the transition from a situation in which no compensation occurs (no connecting cable active) to a situation in which full compensation occurs with aid of the connecting cable. In particular, FIGS. 13*a*–13*e* shows the compensator (21), the connecting cable (105), winches (106 and 107), and the hoisting cable (16).

Figure 13A:
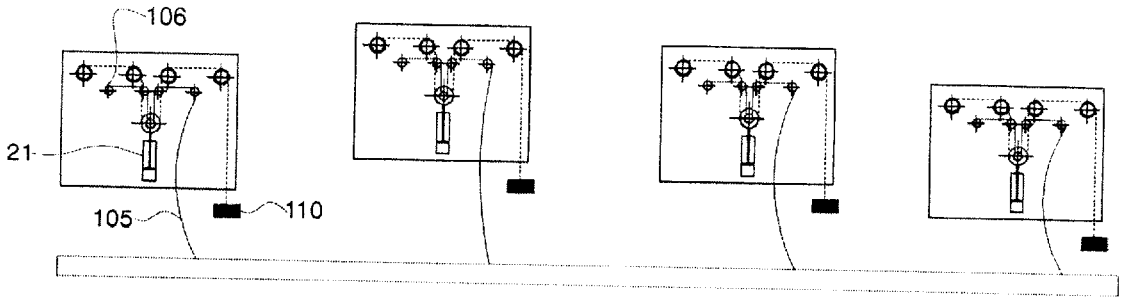
FIGS. 13*a*–13*e* show stepwise the transition form a situation in which on compensation occurs to a situation in which full compensation occurs with the aid of the connecting cable.
Figure 13B:
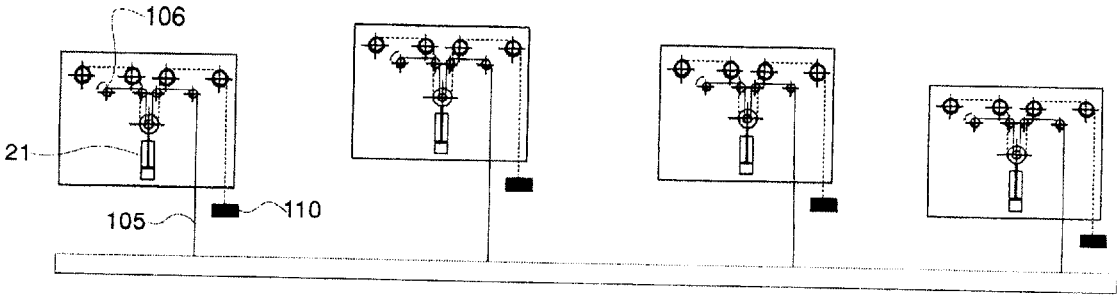
Figure 13C:
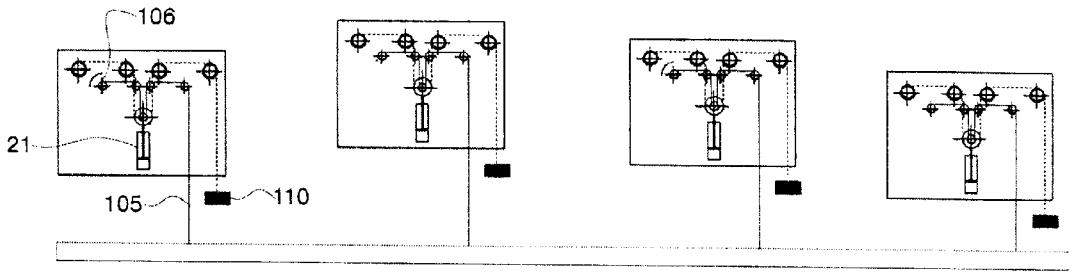
Figure 13D:
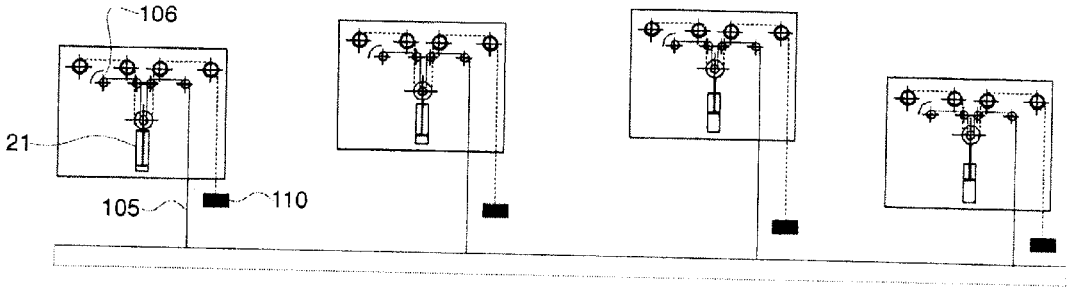
Figure 13E:
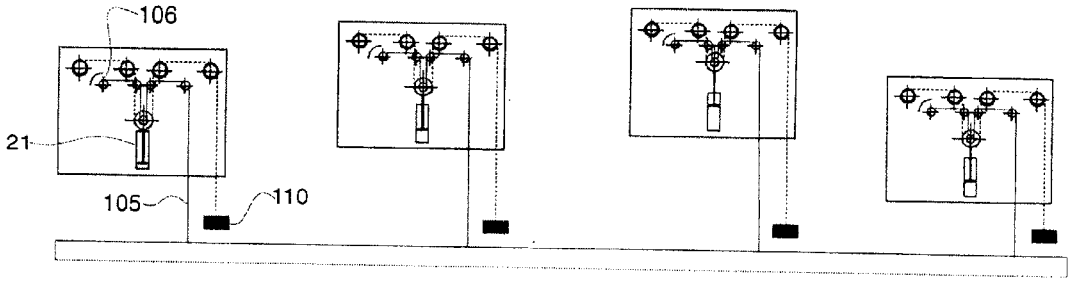
Figure 14A:
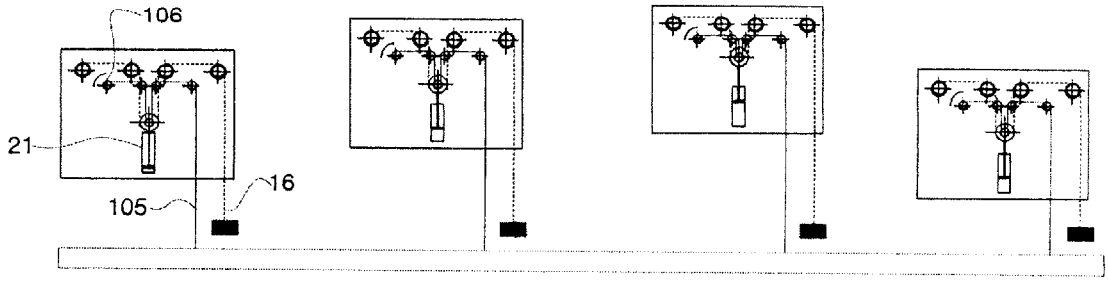
FIGS. 14*a*–14*d* show stepwise the transition from a situation with full compensation using the connecting cable to a situation without compensation.
Figure 14B:
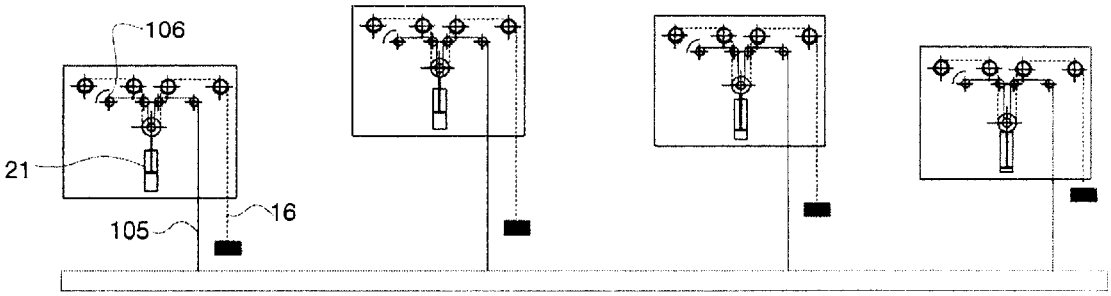
Figure 14C:
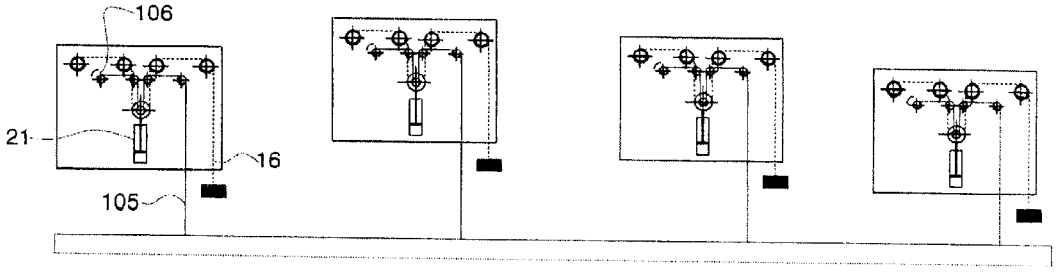
Figure 14D:
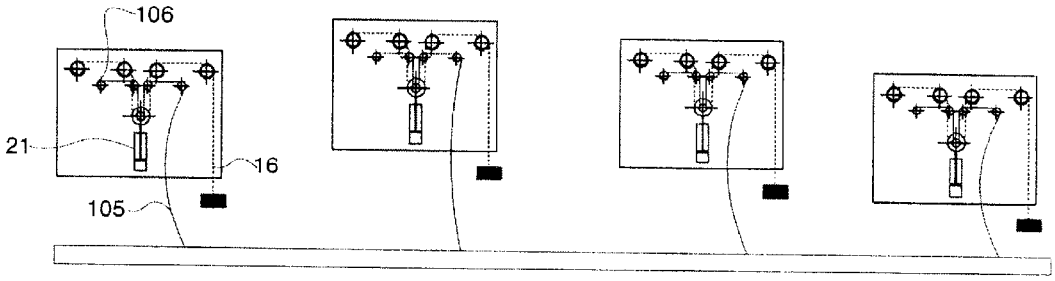

Putting the riser connect winch into position is carried out as follows:

The compensator 21 is positioned in the lowest position the moment the vessel finds itself in the trough of a wave or moves downwards (FIG. 13*a*). A certain pulling force is then exerted upon the connecting cable 105. At least one of the winches 106, 107 (shown in FIG. 10) is operated in such a way that the connecting cable 105 can follow the movement of the vessel relative to the seabed (FIG. 13*b*). The winches 106 and 107 are controlled in such a way that they take the slack out of he connecting cable. When the cable is taut, the passive compensator is taken slowly to the middle position. The riser connect winches are then stopped and there is active compensation in the system by means of the connection of the riser.

The connecting cable can also be used during drilling. The moment a drill head on a drill string makes contact with the earth's surface the tension on the hoisting cable 16 will decrease slightly. This decrease in the load upon the hoisting cable is taken over by the connecting cable. Depending on the rigidity of the drill string and the hardness of the ground, this load will vary between a value equal to zero and the value of the full weight of the drill string. On account of the possibly high loading on the connecting cable 105, care must be taken to prevent overloading of said cable 105 (13*e*).

FIGS. 14*a*–14*d* show stepwise the transition from a situation with full compensation (using the connecting cable) to a situation without compensation. In particular, FIGS. 14*a*–14*d* shows the compensator (21), the connecting cable (105), winches (106 and 107), and the hoisting cable (16).

When the function of the connecting cable has to be ended, first of all a maximum tension is placed upon the connecting cable 105 by means of the fast winch (14*a*).

The cable on the winch is hen paid out, and the compensator slides in/out.

If desired, the compensator can be locked if it is slid in fully. In addition, the cable on the winch is paid out further, so that the connecting cable ultimately hangs loose.

A known problem in the case of drilling vessels according to the prior art is the placing of heavy objects on the bottom of, for example, the sea. With reference to FIG. 12*a*, it is pointed out above that the connecting cable 105 is not used during the placing of objects, such as the riser and the BOP, on the seabed. Owing to the presence of the passive compensators in the reeving of the hoisting cable 16, the placing of such objects on the seabed according to the invention can, however, be carried out in an advantageous manner. This is described below with reference to FIGS. 15 and 16.

Figure 15:
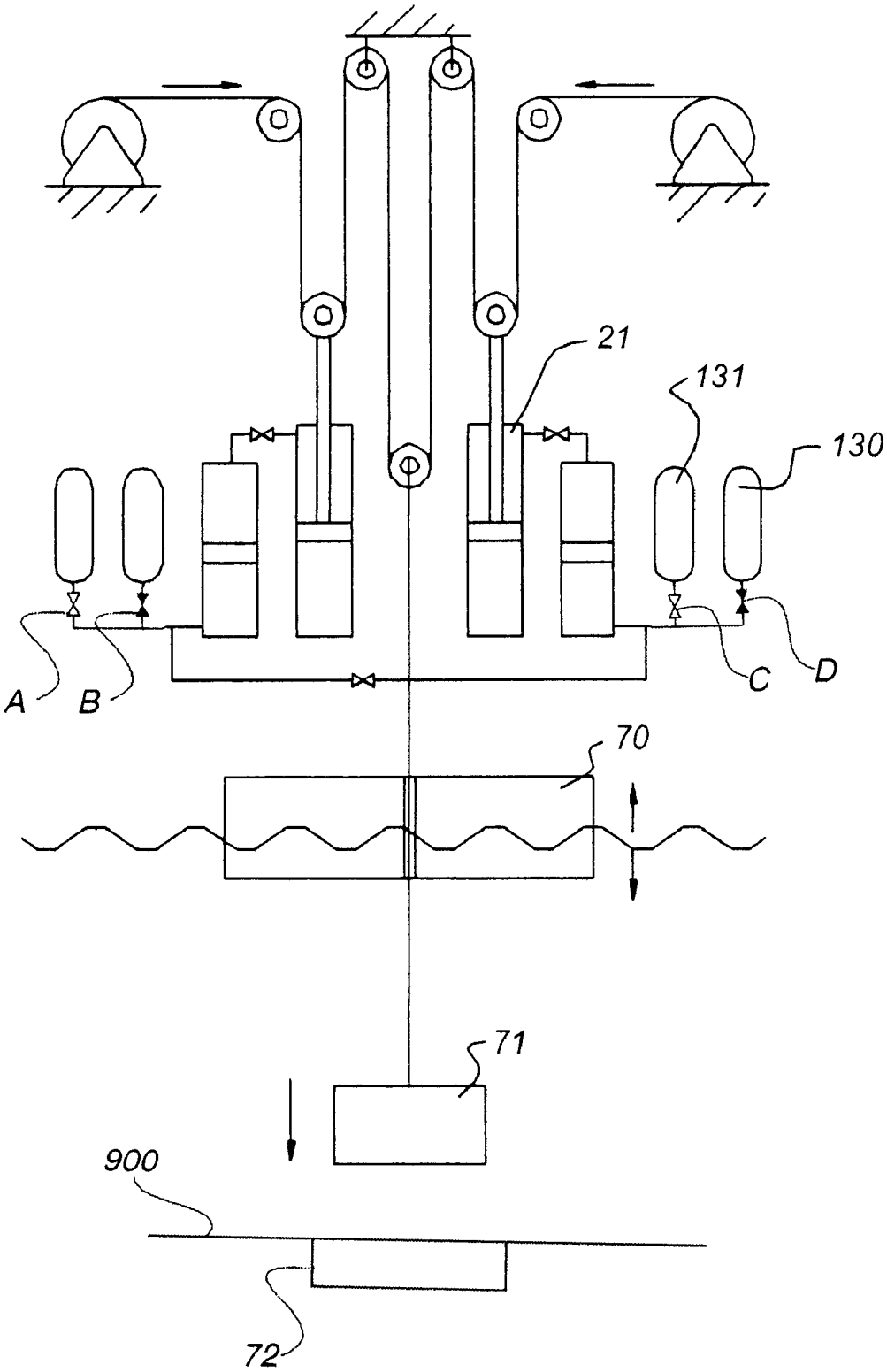
FIGS. 15–16 show diagrammatically the possibility of placing objects on the ground beneath the vessel using the hoisting device with passive compensation according to the present invention, fixed on a vessel.
Figure 16:
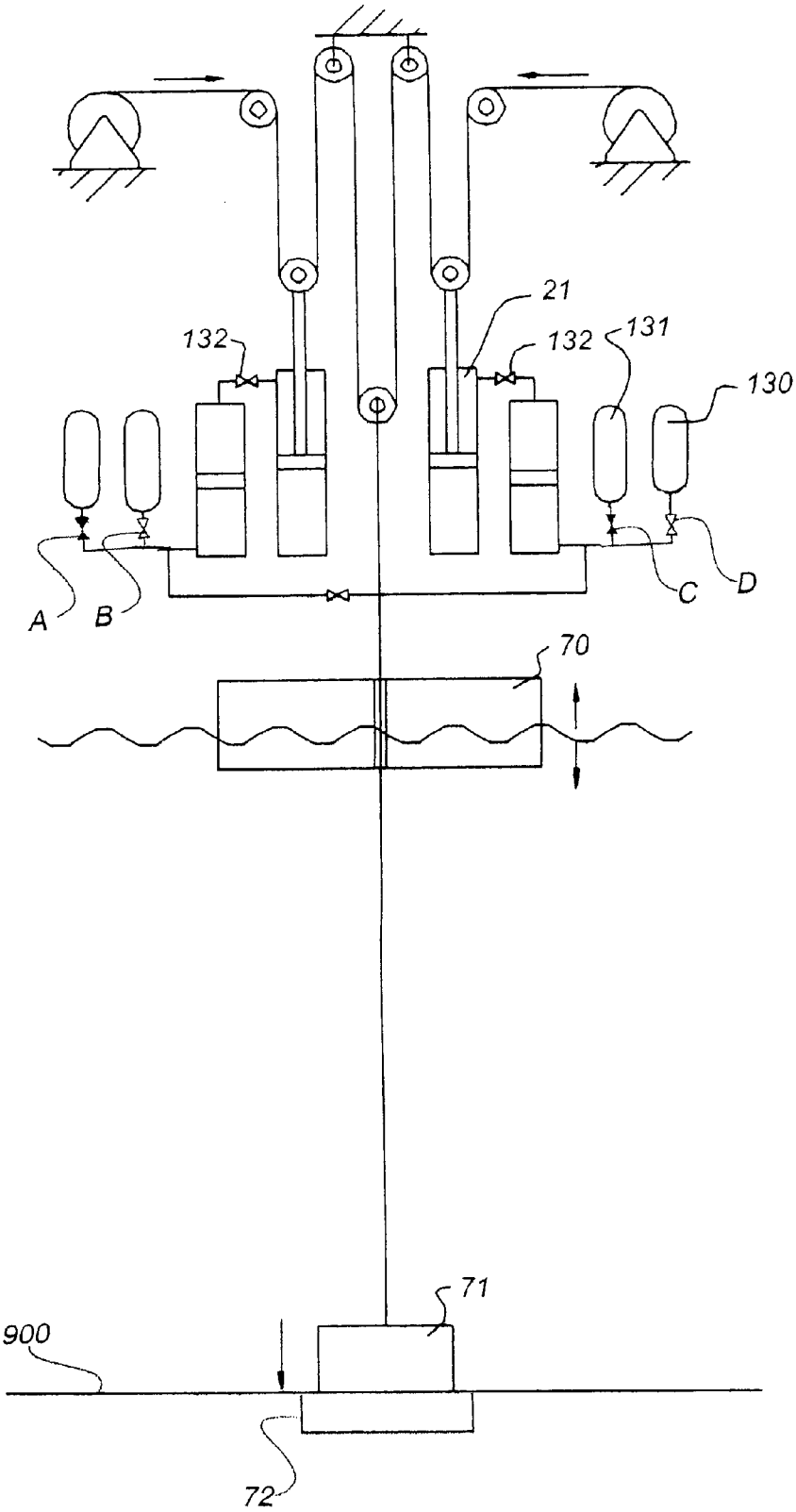

According to FIGS. 15 and 16, a load, such as, for example, a blow-out preventer (BOP) 71 is moved in the direction of the seabed 900 beneath a drilling vessel 70 (shown diagrammatically). The BOP is, for example, placed on a template 72 present on the seabed 900. Since the drilling vessel 70 will never be entirely stationary relative to the seabed 900, owing to the waves and the heave, during the placing of the BOP 71 on the template there is the risk that, owing to the heave of the vessel 70, the BOP will be placed on the template 72 at an uncontrolled speed. The BOP 71 could be damaged as a result. According to FIG. 16, the load has reached the seabed 900.

The system according to FIGS. 15 and 16 works as follows:

The installation on the vessel 70 consists of one or two hydraulic cylinders or compensators 12. Said compensators 21 are connected to pressure vessels 130 filled with gas, so that a certain pre-pressure is built up in the pressure vessels. The compensators 12 are connected to the pressure vessels 130 by way of a medium separator 131, also known as a hydraulic accumulator. The pre-pressure or P(load) of one of the pressure vessels corresponds to the hydraulic pressure in the compensator that is needed to keep the load 71 in balance under water. Another pressure vessel 130 is provided with a low pre-pressure P(low) which corresponds to the tension on the hoisting cable 16 at the moment when the load 71 makes contact with the seabed (see FIG. 16). Various valves 132 are incorporated in the system, in the connection between the hydraulic compensator 21, the hydraulic accumulator 131 and the pressure vessels 130.

When the load is under water, the loading in the hydraulic compensators 21 corresponds to the loading upon the hoisting device. The hydraulic compensators are connected to only one of the pressure vessels 130, by way of the hydraulic accumulator 131. During the sinking of the load, the valves A and C (see FIGS. 15 and 16) are open, while the valves B and D are closed The system reacts as a heave compensator with a rigid characteristic. The operator of the system can determine the position of the load by means of the hoisting device. When the load 71 reaches the seabed, the valves A and C are closed and the valves B and D are opened simultaneously. At that moment the system reacts as a system of constant tension, in the case of which the loading upon the hoisting device is kept constant at a predetermined (low) value. Since a relatively large gas volume is present in the hydraulic accumulators, the system now has the characteristic of a slack spring. In this configuration the system compensates for movements of the vessel 70 relative to the seabed.

What is claimed is:

1. A hoisting device (1) for a vessel comprising: a mast (2) on the top side provided with fixed cable blocks; a trolley (10) including pulleys, which are moveable, and on the bottom side is provided with means (12) for gripping a load; hoisting means, at least equipped with a hoisting cable (16) and a winch (18), the hoisting cable (16) being guided over the cable blocks and pulleys of both the mast and the trolley, to move the trolley (10) relative to the mast (2) with the aid of the hoisting means; and at least two compensators in the form of pneumatic or hydraulic cylinders, for damping movements of the vessel (70) as a result of heave and beating of the waves, characterized in that the hoisting cable (16) is guided over cable pulleys (20) which are connected to the ends of the compensators, the mast is designed in the form of a tube or sleeve, and in that the compensator (21) is placed in the mast (2) and each of said compensators are connected to cable pulleys (20) at its end.

2. A hoisting device (1) for a vessel comprising a mast (2) on the top side provided with fixed cable blocks; a trolley (10) including pulleys which are moveable, and on the bottom side is provided with means (12) for gripping a load; hoisting means, at least equipped with a hoisting cable (16) and a winch (18,19), the hoisting cable (16) being guided over the cable blocks and pulleys of both the mast and the trolley, to move the trolley (10) relative to the mast (2) with the aid of the hoisting means; and a compensator (21) in the form of a pneumatic or hydraulic cylinder, for damping movements of the vessel (70) as a result of heave and beating of the waves, characterized in that the hoisting cable (16) is guided over cable pulleys (20) which are connected to the ends of the compensator (21), the mast is designed in the form of a tube or sleeve, and the compensator (21) is placed in the mast (2).

3. The hoisting device according to claim 2, characterized in that the hoisting means are provided with two winches, (18, 19) each end of the hoisting cable (16) being wound into a separate winch (18, 19).

4. The hoisting device according to claim 3, characterized in that the winches (18, 19) are driven by a plurality of motors with low inertia.

5. The hoisting device (1) according to claim 2, characterized in that the hoisting cable (16) is also guided over the pulley wherein the pulley further comprises at least one loose pulley (17) which is movable between a first position, in which the loose pulley (17) is connected to the mast (2), and a second position, in which the loose pulley is connected to the trolley (10).

6. The hoisting device (1) according to claim 5, characterized in that the at least one pulley is fitted relative to the center of the mast (2).

7. The hoisting device according to claim 5, characterized in that the at least one pulley is accommodated in a housing (53), which at least on the bottom side is provided with locking elements (104) for fixing the at least one pulley on the trolley (10).

8. The hoisting device according to claim 7, characterized in that the locking elements (104) are equipped with a hydraulic actuation device.

9. The hoisting device according to claim 2, characterized in that the hoisting device is provided with a connecting cable (105), for connecting the vessel to a stationary section, such as a top side of a riser (78), which connecting cable (105) is guided over the cable pulleys (20) connected to the end of the compensator (21), in order to be able to exert a force upon the compensator (21) with the connecting cable.

10. The hoisting device according to claim 9, characterized in that each end of the hoisting cable (16) is wound onto a separate winch (106, 107).

11. The hoisting device according to claim 10, characterized in that at least one of the winches (106, 107) is provided with a slip brake, for paying out the connecting cable (105) when a maximum pulling force in the connecting cable (105) is exceeded.

12. The hoisting device according to claim 9, characterized in that the connecting cable (105) is also guided over loose pulleys, which are movable between a first position, in which the loose pulleys are connected to the mast (2), and a second position, in which the loose pulleys are connected to a stationary section, such as the top side of the riser (78).

13. The hoisting device according to claim 2, characterized in that the mast (2) is provided at the top side, on both sides of the hoisting cable (16), with a fastening (101) for attaching a pull rod or pull cable (102).

* * * * *